United States Patent [19]

Nelson

[11] Patent Number: 4,535,538

[45] Date of Patent: Aug. 20, 1985

[54] COMBINATION NON-DISPOSABLE TABLE UTENSIL

[76] Inventor: Shelby W. Nelson, 170-15th Ave. Northeast, Minneapolis, Minn. 55413

[21] Appl. No.: 598,906

[22] Filed: Apr. 10, 1984

[51] Int. Cl.[3] ..... A47G 21/06

[52] U.S. Cl. ..... 30/147; D7/137

[58] Field of Search ..... 30/147, 149, 150; D7/137, 138

[56] References Cited

U.S. PATENT DOCUMENTS

| | | | |
|---|---|---|---|
| 147,119 | 2/1874 | Francis | 30/147 |
| 2,216,005 | 9/1940 | Goldstein | 30/150 X |
| 2,473,288 | 6/1949 | McNeill | 30/147 |

FOREIGN PATENT DOCUMENTS

| | | | |
|---|---|---|---|
| 1061972 | 2/1953 | France | 30/150 |
| 8989 | of 1891 | United Kingdom | 30/150 |
| 590004 | 7/1947 | United Kingdom | 30/147 |
| 1319811 | 6/1973 | United Kingdom | 30/147 |

*Primary Examiner*—Jimmy C. Peters

*Attorney, Agent, or Firm*—Herman H. Bains

[57] ABSTRACT

A combination non-disposable table utensil capable of performing as a knife, fork or spoon having a handle with a scoop extending from one end thereof. At one end of the scoop, a plurality of tines extend outwardly therefrom. The scoop also includes first and second edges with a beveled edge extending along the entire length of the first edge. The beveled edge is capable of severing food materials upon a rocking action being applied to the handle. Between each adjacent tine is an indentation have a long and short edge which are connected by a downwardly sloping edge. The shape of the indentations maximizes the surface area of the scoop to better retain liquid materials within the basin bowl of the scoop.

2 Claims, 4 Drawing Figures

COMBINATION NON-DISPOSABLE TABLE UTENSIL

BACKGROUND OF THE INVENTION

This invention relates to the field of combination utensils which can be a fork, knife or spoon, and is intended for use by the fast food and outdoor industries and the military in the field.

A combination knife, fork and spoon has been embodied in a number of prior art patents. U.S. Pat. No. 2,473,288 to McNeill is representative of the prior art patents. The McNeill patent discloses a combination table utensil which functions as a spoon, knife and fork. The utensil has a handle and is provided with a bowl or scoop at one end which is serrated along one edge and which has tines or prongs projecting from the end thereof. The McNeill type utensil has the disadvantage that the cutting edge is serrated, which can cause injury to the mouth when the utensil is used as a fork or spoon. It has therefore been found desirable to provide a combination utensil which has a nonserrated edge capable, upon rocking action, of severing food material.

The McNeill design also has the disadvantage that the McNeill tine and scoop arrangement maximizes seepage of liquid materials. It is therefore further desirable to provide a combination utensil which includes a tine and scoop arrangement which retains liquid foods, such as soup, effectively.

U.S. Pat. Nos. 843,953 to Laramy, 147,119 to Francis, and 3,967,376 to Foley all disclose combination knife, fork or spoons. These prior art patents disclose utensils which are too bulky for today's application, and the tines protruding to function as a fork are not part of the spoon. It is, therefore, further desirable to provide a combination utensil which is non-disposable, is injection molded of lightweight plastic, such as polystyrene, and has sufficient rigidity to withstand repeated manual pressure.

It has further been found desirable to provide a combination utensil which is compact and economically manufactured.

The present invention is directed toward solving these problems and provides a workable and economical solution to them.

SUMMARY OF THE INVENTION

A non-disposable combination eating utensil capable of functioning as a knife, fork or spoon, the invention includes an elongated handle terminating at one end with a concavo-convex scoop. The scoop functions in the manner of a spoon. Tines protrude outwardly from the end of the scoop opposite the point at which the handle is attached, and function in the manner of a fork. The scoop includes a first edge and a second edge, and also includes a basin bowl for containment of solid or liquid food materials. The first edge of the scoop is parallel to the plane of the handle, and is beveled along its entire length to function as a knife when used with a rocking motion. The first edge is nonserrated to prevent injury to the mouth of a user. The handle is centered proportionally between the first and second edges so as to provide proper balance when in use.

The scoop also includes a plurality of indentations between each adjacent tine. The indentations are designed to minimize liquid seepage when the utensil is used as a spoon. The indentations include a short and long edge which are connected by a downwardly sloping edge.

Other objects and advantages of the invention will become apparent from the following description and from the appended drawings in which like numbers have been used to describe like parts of the several views.

DESCRIPTION OF THE PREFERRED EMBODIMENT

Figure 1:
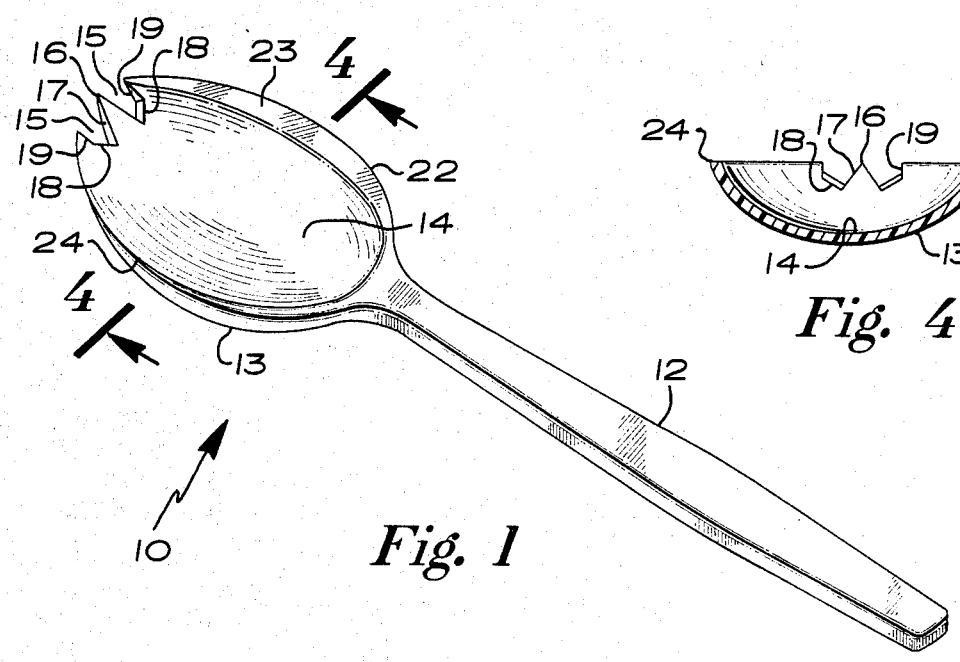
FIG. 1 is a front perspective view of the combination non-disposable table utensil.

Referring now to the drawings, and more specifically to FIG. 1, a combination non-disposable table utensil 10 has an elongated handle 12 having a concavo-convex scoop 13 at one end. The scoop 13 has a curved surface forming a basin bowl 14 for retention of food materials. The scoop 13 functions as a spoon. At one end of the scoop 13 are a plurality of tines 16 extending outwardly therefrom. The tines 16 function generally in the manner of a fork.

Figure 4:
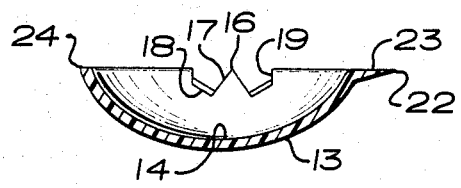
FIG. 4 is an end view taken along line 4—4 of FIG. 1 and looking in the direction of the arrows.
Figure 2:
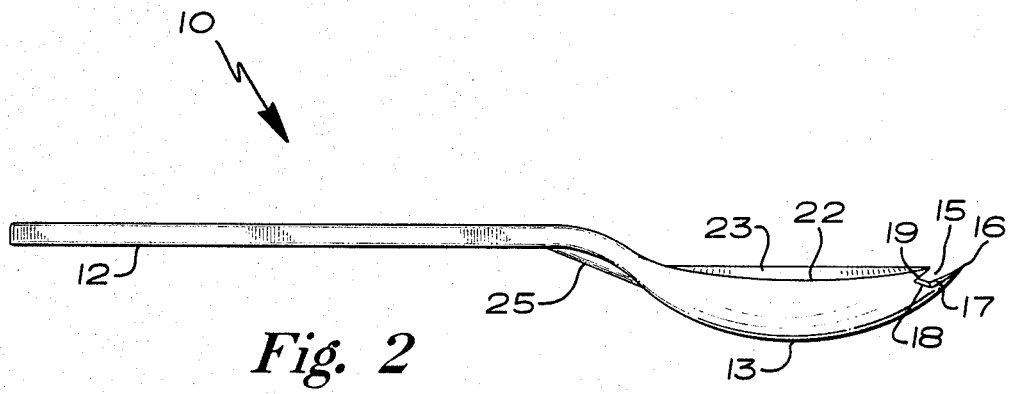
FIG. 2 is a side elevational view of the combination non-disposable table utensil.
Figure 3:
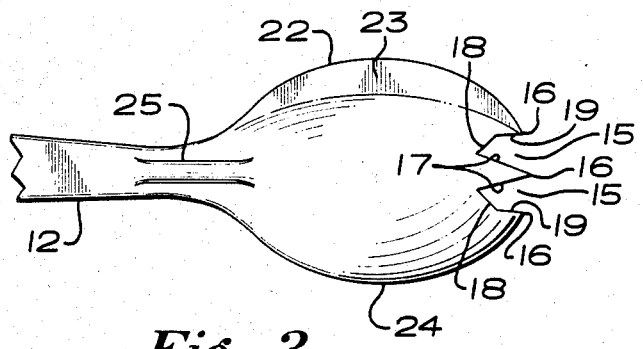
FIG. 3 is an enlarged top view of the combination non-disposable table utensil of FIG. 1 illustrating the scoop and tine arrangement.

The scoop also includes a first edge 22 and a second edge 24. The first and second edges 22 and 24, respectively, terminate at one end with a tine 16. As shown in FIGS. 1 and 4, the first edge 22 has a bevel edge 23 along its entire length. The bevel edge 23 can sever food materials upon rocking pressure on the handle 12, and therefore function as a knife. The bevel edge 23 may be sharpened, but is nonserrated to prevent injury to the mouth of a user. The first edge 22 is parallel to the plane of the handle 12 to maximize the severing potential of first edge 22 when force is applied to the handle 12.

The utensil 10 is preferably about eight inches long, one and one-half inches wide and three-eighths inches deep. In the preferred embodiment, the utensil 10 will weigh 10 grams. The utensil 10 is preferably made of an injection-molded polycarbon, such as polystyrene. This material permits the handle 12 to be of sufficient rigidity to withstand vigorous manual pressure. The rigidity of the handle 12 is fortified by support structure 25. The handle 12 is also centered proportionally between the first edge 22 and the second edge 24 so as to provide balance to the user, especially when liquid food materials are contained within the scoop 13.

Between each adjacent tine 16 at the end of scoop 13 is an indentation 15. Each indentation 15 includes a long edge 17 and a short edge 19. The long and short edges 17 and 19, respectively, are connected by a downwardly sloping edge 18. The indentations 15 cooperate with the tines 16 to maximize the surface area of the scoop 13 for containment of liquid materials within the basin bowl 14 of the scoop 13.

While the preferred embodiment of the present invention has been described, it should be understood that various changes, adaptions and modifications may be made therein without departing from the spirit of the invention and the scope of the appended claims.

What is claimed is:

1. A non-disposable eating utensil molded from an inert plastic material, comprising:

a handle of sufficient rigidity to withstand vigorous manual pressure and having a concave-convex scoop at one end, said scoop being generally in the shape of a spoon;

tines extending outwardly from one end of said scoop, said tines functioning generally in the manner of a fork;

said scoop having first and second edges and a basin bowl, said first edge being parallel to the plane of said handle and beveled along its length to function as a knife, and capable, under rocking pressure, to sever food, said first edge being nonserrated to prevent injury to the mouth of a user, said scoop having a smoothly uninterrupted concave upper surface;

said handle being centered proportionally between said first and second edges of said scoop so as to provide balance; and said scoop including a plurality of indentations between said tines, said indentations including a short and a long edge, said short and long edges being connected by a downwardly sloping edge, said indentations cooperating with said tines so that the upper surface of the latter is co-extensive with the upper concave surface of the scoop thereby maximizing surface area for containment of liquid materials within said basin bowl of said scoop.

2. The non-disposable eating utensil of claim 1 wherein said handle, scoop and tines are made of polystyrene, thereby promoting strength to the utensil.

* * * * *